US012442270B2

(12) United States Patent
Hecht et al.

(10) Patent No.: US 12,442,270 B2
(45) Date of Patent: Oct. 14, 2025

(54) DISSOLVABLE RELEASE ACIDIZING PLUG

(71) Applicant: Wyoming Completion Technologies, Inc., Powell, WY (US)

(72) Inventors: Scott J. Hecht, Powell, WY (US); Nathaniel Hecht, Powell, WY (US)

(73) Assignee: Wyoming Completion Technologies, Inc., Powell, WY (US)

( * ) Notice: Subject to any disclaimer, the term of this patent is extended or adjusted under 35 U.S.C. 154(b) by 0 days.

(21) Appl. No.: 18/216,078

(22) Filed: Jun. 29, 2023

(65) Prior Publication Data

US 2025/0003309 A1 Jan. 2, 2025

(51) Int. Cl.

| | |
|---|---|
| ***E21B 33/128*** | (2006.01) |
| ***E21B 34/06*** | (2006.01) |
| ***E21B 43/27*** | (2006.01) |

(52) U.S. Cl.

CPC ..... *E21B 33/128* (2013.01); *E21B 34/063* (2013.01); *E21B 43/27* (2020.05)

(58) Field of Classification Search

CPC ..... E21B 33/128; E21B 34/063; E21B 43/27

See application file for complete search history.

(56) References Cited

U.S. PATENT DOCUMENTS

| | | | | |
|---|---|---|---|---|
| 10,995,583 | B1 * | 5/2021 | Helms | E21B 34/063 |
| 11,506,017 | B2 * | 11/2022 | Petrowsky | E21B 34/063 |
| 2011/0308819 | A1 * | 12/2011 | Frazier | E21B 34/063 166/177.5 |
| 2013/0240203 | A1 * | 9/2013 | Frazier | E21B 34/063 166/192 |
| 2018/0073321 | A1 * | 3/2018 | Watson | E21B 33/124 |
| 2018/0245422 | A1 * | 8/2018 | Fripp | E21B 33/12 |
| 2020/0347694 | A1 * | 11/2020 | Power | E21B 33/1293 |
| 2021/0040811 | A1 * | 2/2021 | Saraya | E21B 33/1208 |
| 2023/0125900 | A1 * | 4/2023 | Purdy | C09K 8/032 166/297 |
| 2023/0243231 | A1 * | 8/2023 | Zakharia | E21B 43/261 166/285 |

* cited by examiner

*Primary Examiner* — Nicole Coy
*Assistant Examiner* — Nicholas D Wlodarski
(74) *Attorney, Agent, or Firm* — AVEK IP, LLC

(57) ABSTRACT

An acidizing plug assembly comprises a mandrel, sealing element, upper and lower backup rings, upper and lower cones, upper and lower slips each having teeth configured to engage a well casing, and a shoe. An external surface of the acidizing plug is configured to be acid-resistant, and one or more breakable plugs prevents acid from reaching an acid-vulnerable portion of the acidizing plug. The breakable plugs are broken when the acidizing plug is no longer needed to permit acid such as hydrochloric acid to dissolve at least a substantial portion of the acidizing plug.

18 Claims, 6 Drawing Sheets

DISSOLVABLE RELEASE ACIDIZING PLUG

FIELD

The invention relates generally to oil and gas extraction and, more particularly, to a dissolvable release acidizing plug.

BACKGROUND

Oil and gas are a primary source of energy for much of the world, and are the raw materials from which many plastics, pharmaceuticals, and other products are made. The transportation industry relies almost exclusively on gasoline, kerosene, other products derived from oil drilling, and heating is largely provided by natural gas. Natural gas is typically found in pockets or reservoirs in the ground where remains of prehistoric plants and animals have decomposed in the absence of oxygen to form carbon-rich organic compounds that with heat and pressure over time became products such as natural gas and crude oil. These products tend to accumulate in porous limestone or sandstone, but can also be found in shale where such accumulation has not happened or is incomplete.

Geologists search for oil and gas by using seismology and other methods to look for accumulations of oil and gas in such pockets, or by looking for shale deposits likely to have high oil and gas content. Once an area of interest is found, a well is drilled such as by using a large bit to bore a hole through rock and sediment while water or other material is circulated through the drill pipe and out the bored hole to clear the hole of drilled debris. A casing or large diameter pipe is then placed in the bored hole to stabilize the hole, and cement is pumped between the casing and the bored hole to stabilize the bored hole.

When a bore hole is complete, a perforating gun is typically lowered to a point at which oil or gas is believed to be present, and explosive charges create holes in the casing through which oil and gas can flow. The perforated casing typically will not result in a "gusher" of oil as is popularly seen on television and in the movies, but may require acid etching, pressurized steam, hydraulic fracturing, or other treatment of the geology surrounding the perforated area of the bore hole casing to result in oil flow. A pump coupled to the bore hole at the ground surface is typically employed to create suction in the bore hole to extract oil and gas from the bored hole.

Where oil and gas have not yet accumulated in large reservoirs but are still trapped in geologic formations, a process known as fracking or hydraulic fracturing is used to create fractures in the shale surrounding the perforations in the casing before trying to extract oil or gas. Gas exploration similarly often uses a method known as acidizing, in which hydrochloric acid is introduced rather than fracking fluid to etch away geologic formations that have trapped natural gas deposits.

Because a bore hole may run thousands of feet, especially for horizontal drilling, it is often desirable to perform these fracturing or acidizing processes at intervals along the bore casing to better harvest oil and/or gas from a large area along the bore hole. To do this, a type of fracking called plug-and-perf is employed, in which a segment of the bore hole is perforated before a fracking fluid is pumped in under high pressure to fracture the surrounding rock, that segment is plugged or isolated, and the next segment is perforated and fractured. This process is repeated until the entire region of interest is perforated and fractured, and the plugs used as part of the process are drilled out.

But, the plugs used for processes such as acidizing must be able to withstand the hostile environment created by pumping hydrochloric acid into the bore hole without moving within the bore hole, while also being removable after the acidizing process is complete so that natural gas can be extracted. Traditional plugs often take more than a significant time to drill out per plug, and can be difficult to drill out if various complications arise, such as if they become dislodged or spin during the drilling process. For these and other reasons, an improved acidizing plug is desired.

SUMMARY

One example embodiment comprises an acidizing plug assembly having a mandrel, sealing element, upper and lower backup rings, upper and lower cones, upper and lower slips each having teeth configured to engage a well casing, and a shoe. An external surface of the acidizing plug is configured to be acid-resistant, and one or more breakable plugs prevents acid from reaching an acid-vulnerable portion of the acidizing plug. The breakable plugs are broken when the acidizing plug is no longer needed to permit acid such as hydrochloric acid to dissolve at least a substantial portion of the acidizing plug.

The details of one or more examples of the invention are set forth in the accompanying drawings and the description below. Other features and advantages will be apparent from the description and drawings, and from the claims.

DETAILED DESCRIPTION

Figure 1:
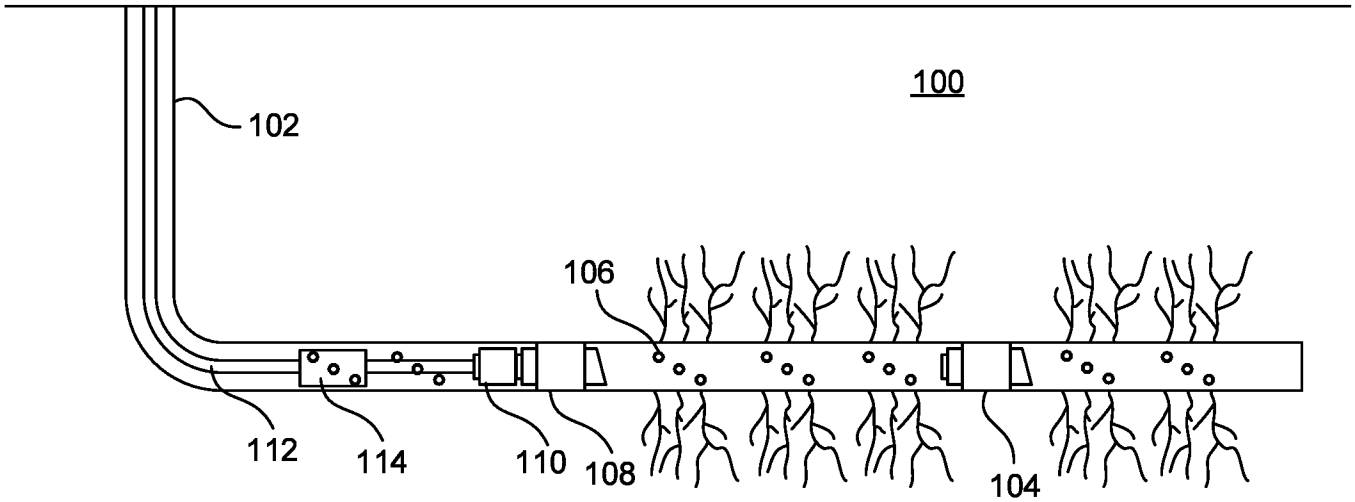
FIG. 1 shows a horizontal gas well, consistent with an example embodiment.

In the following detailed description of example embodiments, reference is made to specific example embodiments by way of drawings and illustrations. These examples are described in sufficient detail to enable those skilled in the art to practice what is described, and serve to illustrate how elements of these examples may be applied to various purposes or embodiments. Other embodiments exist, and logical, mechanical, electrical, and other changes may be made.

Features or limitations of various embodiments described herein, however important to the example embodiments in which they are incorporated, do not limit other embodiments, and any reference to the elements, operation, and application of the examples serve only to define these example embodiments. Features or elements shown in various examples described herein can be combined in ways other than shown in the examples, and any such combinations is explicitly contemplated to be within the scope of the examples presented here. The following detailed description does not, therefore, limit the scope of what is claimed.

Drilling for natural gas is becoming increasingly difficult, as much of the natural gas that is the easiest to extract has already been located and extracted. Complex drilling techniques, such as horizontal drilling, hydraulic fracturing or fracking, acidizing, and the like have therefore become commonplace in oil and gas fields around the world. Further, the depth of such wells is becoming increasingly deeper to reach yet untapped oil reserves, with horizontal wells extending 5,000 feet to 10,000 feet or more being common. For example, many horizontal wells now extend well beyond 5,000 feet through geologic structures that which must be acidized, hydraulically fractured, or both to release natural gas or oil from the many pockets typical geologic formations.

A typical oil and gas well is drilled such as by using a large bit, such as from 5-10 inches in diameter, to bore a hole through rock and sediment while water or other liquid is circulated through a drill pipe and out the bored hole to clear the hole of drilled debris. A casing or large diameter pipe is then placed in the bored hole to stabilize the hole, and cement is pumped between the casing and the bored hole to stabilize the casing in the bored hole. The completed hole is then prepared for fracking or acidizing by lowering a perforating gun in the casing and using explosive charges to crate holes in the casing through which fracking fluid or hydrochloric acid can be pumped to create a passage between pockets of oil and gas in the shale formation and the casing.

Acidizing generally works by using an acid such as hydrochloric acid to dissolve part of a geologic formation, freeing oil and gas to be extracted. Hydraulic fracturing or fracking similarly works by using high pressure fracking fluid to break apart or fracture geologic formations to free trapped oil and gas. Acidizing is often further categorized as matrix acidizing, in which acid is pumped into the well at pressures below the formation fracturing pressure and completes its work by dissolving rather than fracturing the geologic formations, and fracture acidizing, in which acid is pumped into the well at pressures up to thousands of pounds per square inch such that the acid both fractures and dissolves the geologic formations. Although acidizing is often associated with natural gas wells and hydraulic fracturing is often associated with oil wells, both oil and gas may be extracted from wells using either method.

In deep bore holes, the acidizing process may be repeated many times over the length of the bore hole, and plugs are used to seal completed deeper portions of the bore hole while subsequently acidizing shallower regions. This process is often called plug-and-perf, because a plug separates portions of the bore hole that have already been perforated and acidized from the portion currently being acidized. Once the plug-and-perf process is complete, the plugs are all drilled from the bore hole so oil and gas can be extracted. Because acidizing plugs must be able to hold their position within the casing under the caustic environment of hydrochloric acid, they are often difficult to drill out so that oil and gas can be extracted after the acidizing process is complete. Further, as bore holes extend many thousands of feet deep, the plugs become increasingly difficult to drill out from the surface, often taking an hour or more per plug if no problems arise. If the plugs become dislodged or spin during the drilling process, plugs may take many hours to drill out or may not be drilled out at all.

For reasons such as these, some example embodiments of the invention presented herein comprise an acidizing plug that is at least partially soluble in an acid such as hydrochloric acid upon breaking or removing part of the plug, such that the plug can be either substantially dissolved or freed from the casing sufficiently to be moved or removed. In a further embodiment, the acid soluble part of the plug comprises aluminum, magnesium or an aluminum and/or magnesium alloy.

In a more detailed example, a plug comprising a mandrel has a treated area that is resistant to acid and an untreated area that is more vulnerable to being dissolved by acid than the treated area. One or more breakable plugs, such as a ceramic plug or other plug configured to be strong enough to withstand the acidizing process but weak or brittle enough to be able to readily breakable when needed, shields the untreated area from acidizing acid until the plug is broken. Once the breakable plug is broken, the mandrel and optionally one or more other parts of the acidizing plug dissolve in acid such as hydrochloric acid at a substantially faster rate (e.g., 5×, 10×, 20×, or 50× faster) than before the untreated or acid-vulnerable area was exposed to acid.

The acidizing plug is in a simple example used to seal the casing of a bore hole of an oil or gas well while it is matrix acidized or fracture acidized, and once the acidization process is complete the breakable plug is broken, exposing an untreated or acid-vulnerable portion of the acidizing plug to acid and allowing the acidizing plug to dissolve much more rapidly. In more complex examples, the acidizing plug is used to isolate one section of a gas and/or oil well from another during processes such as matrix acidizing or fracture acidizing, facilitating exploration and extraction in large or deep wells.

FIG. 1 shows a horizontal gas well, consistent with an example embodiment. Here, a bore hole is formed in the ground 100, and a casing 102 is inserted into the bore hole. The casing is fixed within the hole by pumping a cement mixture between the casing and the bore hole, fixing the casing's position within the bore hole. One or more acidizing plugs 104 are inserted into the casing such that the acidizing plug seals against the casing, and perforations 106 are formed in the casing between the plug and the ground end of the casing.

In the simplified example shown in FIG. 1, one acidizing plug is already in place, and a second acidizing plug 108 is being set by plug set tool 110. The plug set tool is affixed at the end of a wireline or coiled tubing 112, allowing insertion, extraction, and operation of the plug set tool from above ground. The wireline or coiled tubing also supports a perf gun 114, operable to use an explosive charge to produce perforations in the casing as shown at 106.

Figure 2:
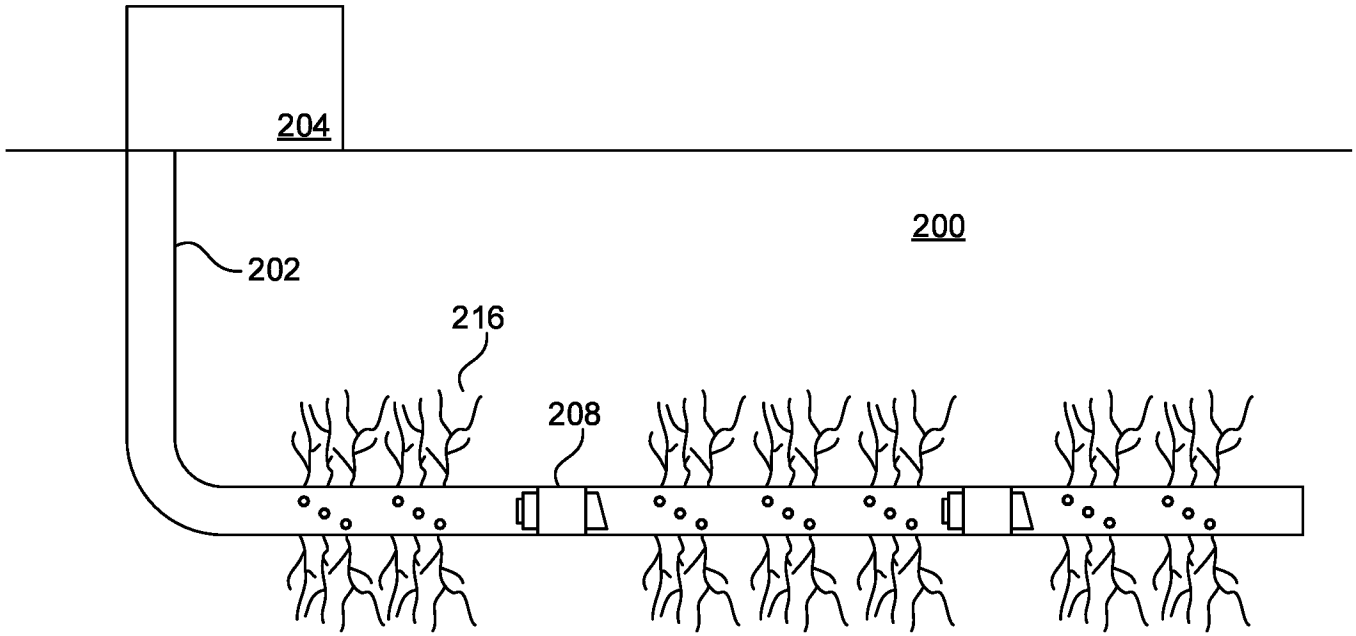
FIG. 2 shows acidizing of geologic structures such as rock in a gas well, consistent with an example embodiment.

FIG. 2 shows acidizing of geologic structures such as rock in a gas well, consistent with an example embodiment. Here, the well of FIG. 1 has its wireline 112, perf gun 114, and frac plug setting tool 110 removed from the casing as shown at 202, and a pump 204 is attached to the casing at the head of the well. The pump supplies acid such as hydrochloric acid into the casing at low pressure such as 100-500 psi for matrix acidizing or high pressure such as 5,000-10,000 psi for fracture acidizing, such that the acid flows out the perforations under pressure and either etches (during matrix acidizing) or etches and fractures (during fracture acidizing) openings 216 in the rock surrounding the perforated portions of the casing. Plug 208 prevents the acid from flowing to perforated portions of the bore hole through which acidizing has already taken place, focusing the fluid pressure on the limited number of newly-formed openings 216.

Figure 3:
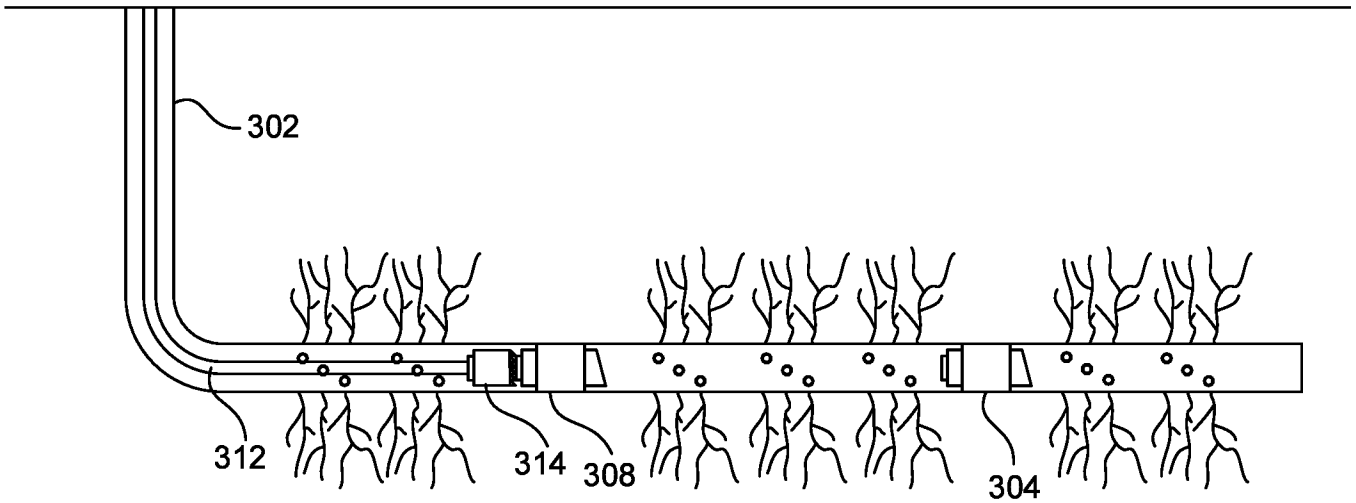
FIG. 3 shows removal of acidizing plugs from a plug-and-perf acidizing gas well, consistent with an example embodiment.

FIG. 3 shows removal of acidizing plugs from a plug-and-perf acidizing gas well, consistent with an example embodiment. Once the desired regions of the casing 302 along which gas is believed to be present have been acidized, the plugs 304 and 308 must be opened, drilled out, or otherwise removed to gas and oil to be pumped from the acidized rock formations surrounding the casing to the surface of the oil well. In this example, wireline or coiled tubing 312 feeds a drill head 314 down to the acidizing plug 308 and rotates the drill head to bore out the fracking plug. The drill head then progresses to the next plug 304, continuing for as many plugs are in the well.

But, while use of a drill head 314 works fairly well near the surface of the gas well where the wireline or coiled tubing distance to the drill head is fairly short, it works progressively less reliably as the distance underground to the drill head increases. In some embodiments of the invention, the drill head 314 is therefore replaced with or supplemented by a tool that is designed to puncture, shatter, drill, or otherwise open at least one breakable plug in the acidizing plug, exposing a portion of the acidizing plug that is acid-vulnerable to acid present in the casing 302. In a more detailed example, the acidizing plug is treated or coated with a material that resists acid on its exterior, such that it dissolves in acid substantially faster in acid once the breakable plug has been opened to expose the acid-vulnerable portion of the plug than before the breakable plug or plugs are broken.

The acidizing plug in another example has a steel shear stud that is engaged with the setting tool, which in a further example shears in a way that provides access to the one or more breakable plugs. For example, the shear stud may be configured to break along an outer radius of a threaded portion of the shear stud designed to engage the mandrel, which in some examples is greater in diameter than the diameter of the shear stud portion that engages with a setting tool. In alternate examples, the shear stud may be removable from the mandrel, such as by rotating via the setting tool or another tool in a certain direction to separate the shear stud from the mandrel or other portion of the acidizing plug assembly.

Figure 4:
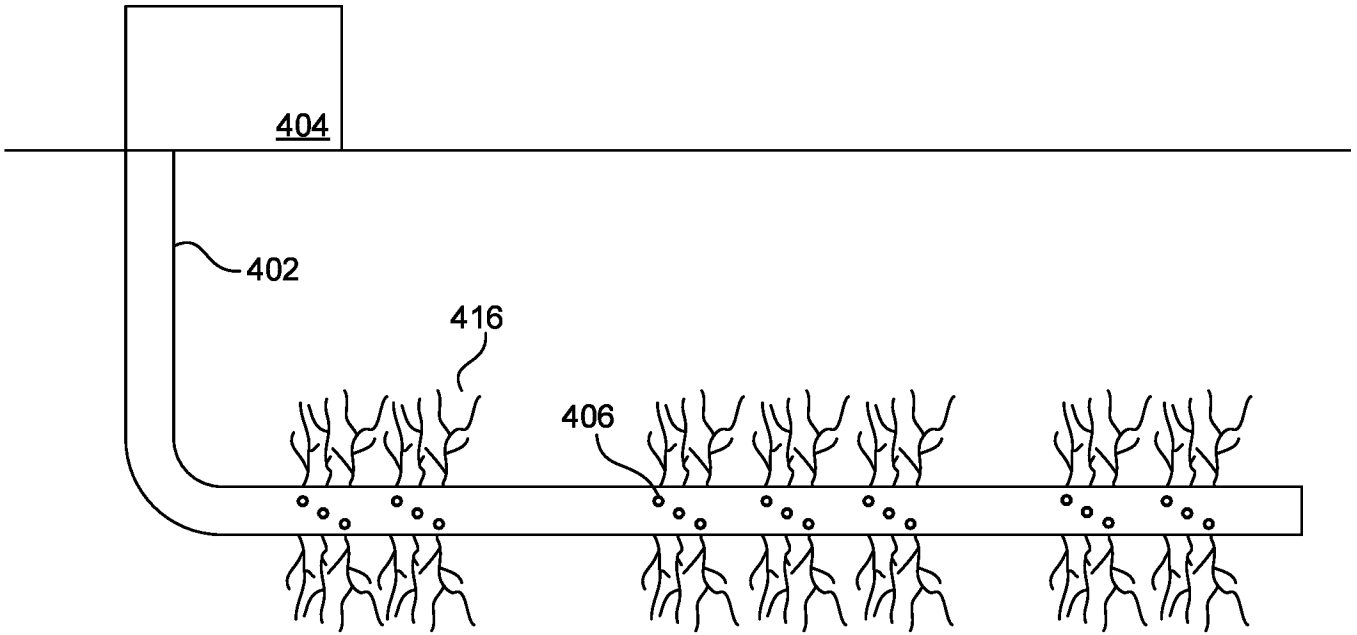
FIG. 4 shows a completed plug-and-perf acidizing gas well ready for oil and gas extraction, consistent with an example embodiment.

FIG. 4 shows a completed plug-and-perf acidizing gas well ready for oil and gas extraction, consistent with an example embodiment. Here, pressure in the oil and gas pockets in the acidized rock formations 416 caused by forces such as water pressure, dissolved gas, and pump 404 cause the oil and gas in the rock formations to be extracted to the surface of the well. In further examples, fluid or steam injection near the rock formations or other such mechanisms are used to enhance pressure in the rock formations and/or make the oil and gas in the rock formations more mobile, making oil and gas extraction easier.

Figure 5:
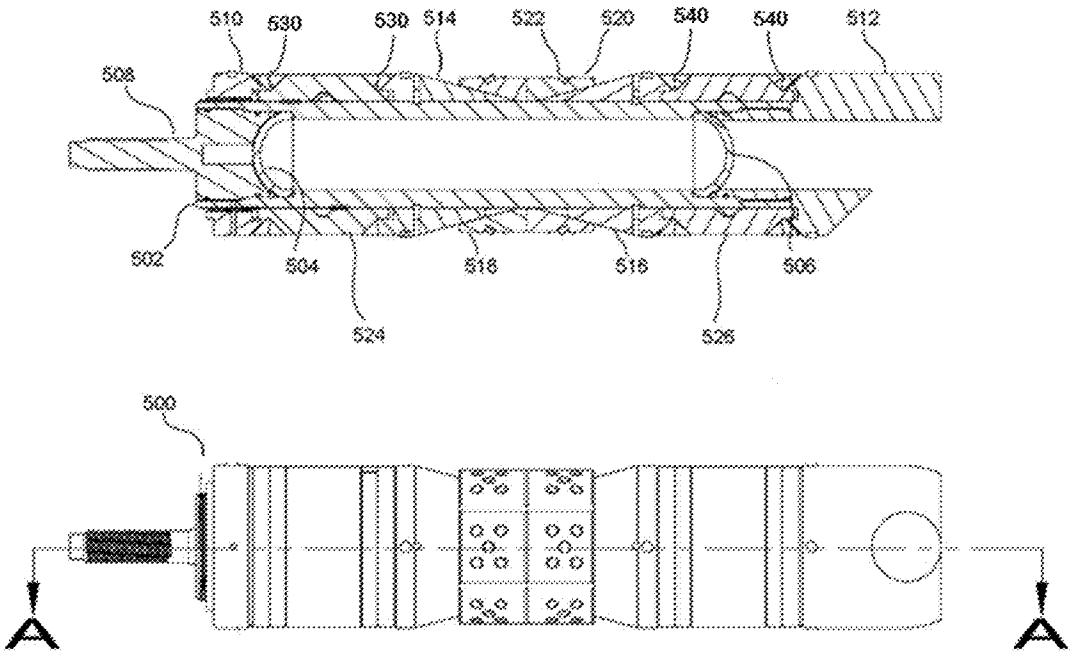
FIG. 5 shows an acidizing plug with breakable plugs, consistent with an example embodiment.

FIG. 5 shows an acidizing plug with breakable plugs, consistent with an example embodiment. More specifically, a cross-section of the acidizing plug shown at 500 is shown above with various elements identified, the cross section taken along the line A-A of the acidizing plug 500. The acidizing plug assembly comprises a mandrel 502, which is the core structure upon which the acidizing plug is assembled. The mandrel in this example has a cylindrical hole extending from top to bottom through its center, such that fluid can flow through the mandrel when breakable upper disk 504 and breakable lower disk 506 are broken to expose a central internal area of the mandrel. The mandrel has a shear stud 508 used for positioning and setting the acidizing plug, such as with a wireline, and a setting ring 510 which is rotated to set the acidizing plug. A shoe 512 both holds the breakable lower disk 506 in position against a rubber O-ring, sealing the breakable lower disc against the mandrel, and supports the slip and cone components used to set the acidizing plug in the casing. The mandrel in this example has a cylindrical outer surface configure to receive the several other components, but in other examples the outer surface will be a polygon such as a hexagon or octagon, or another regular shape configured to receive the several other components.

Upper cone 514 and lower cone 516 engage upper slip 518 and lower slip 520. When the setting ring 510 is screwed toward the shoe 512, it forces the upper and lower cones together which forces the upper and lower slips outward radially from the axis of the mandrel. When the upper and lower slips are forced radially outward by the upper and lower cones, teeth 522 bite into the casing, securing the acidizing plug in place. Upper sealing element 524 and lower sealing element 526 are also forced outward from the radial axis of the mandrel when the setting ring is forced toward the shoe, and in this example are made of a rubber or composite material that is flexible enough to flex and seal against the wall of the oil and gas well's casing but resilient enough to withstand hydraulic pressure in the thousands to tens of thousands of pounds per square inch and still seal properly. In other examples, the sealing element 508 is soluble in an acid solvent, is made of a metallic or semi-metallic compound, or is a fiber-reinforced polymer. The upper and lower sealing elements in this example have a groove in its center as shown, but in other examples do not have a groove or has multiple grooves. The grooves in some such examples are configured to control the amount of flex in the sealing element, to control the region in which the sealing element flexes, or to control both the amount and region of flex. In further examples, one or more upper backup rings 530 and one or more lower backup rings 540 are also positioned on the mandrel, such as between a sealing element and cone or a sealing element and shoe or setting ring, and further examples are semi-flexible such that they can expand slightly to provide a secondary or backup sealing function when seated against the casing of the oil well.

The acidizing plug is assembled by screwing the shoe 512 onto the mandrel 502, with breakable lower disk 506 and one or more sealing O-rings retained between the mandrel and shoe to seal a lower portion of the acidizing plug. Additional elements such as lower sealing element 526, backup rings, lower cone 516 and lower slip 520, upper cone 514 and upper slip 518, additional backup rings, and upper sealing element 524 are then slid in place over the exterior surface of the mandrel. Setting ring 510 is threaded onto the top end of the exterior of the mandrel 502, securing these elements in place on the mandrel between the setting ring 510 and the shoe 512. Shear stud 508 is screwed into the top end of the mandrel, retaining breakable upper disk 504 and one or more O-rings to seal the breakable upper disc against the mandrel.

The acidizing plug assembly is further treated on its exterior surfaces to be resistant to acid, such as hydrochloric acid often used in acidizing oil and gas wells. In a more detailed example, the exterior surface is anodized, coated with an acid-resistant material, or otherwise treated to be acid-resistant. The inner cylindrical surface of the mandrel located between the breakable upper disk 504 and the breakable lower disk 506 is not treated, and is more vulnerable to acid than the exterior surface of the acidizing plug assembly. In a more detailed example, the mandrel comprises aluminum or magnesium, and the inner acid-vulnerable surface of the mandrel is soluble in acid in 1-5 hours while the acid-resistant exterior is soluble in acid in 1-5 days.

In a further example, one or more other elements such as the shoe 512, setting ring 510, upper and lower cones 514 and 516, and upper and lower slips 518 and 520 are soluble in acid, or are more acid-vulnerable on protected surfaces than on surfaces exposed on the exterior of the acidizing plug assembly. Some elements of this example acidizing plug are not acid-soluble, including the steel shear stud 508, carbide teeth 522, and rubber or nitrile O-rings. In the example acidizing plug shown in FIG. 5, approximately 70% of the acidizing plug is soluble in hydrochloric acid.

Once the plug is assembled, it can be placed using methods such as a wire line to guide the plug into position in an oil and gas well casing. When the plug is in the desired position, the threaded setting ring is rotated relative to the threaded mandrel to drive it toward the shoe, causing elements such as the upper sealing element 524 and lower sealing element 526 to bow out and seal the acidizing plug against the casing. Rotating the threaded setting ring to drive it against the mandrel toward the shoe also causes the upper cone 514 and lower cone 516 to be driven toward each other, causing the upper and lower slips to be forced outward from the mandrel body against the casing. The upper and lower slip's teeth bite into the casing, securing the acidizing plug in place in the casing. A plug setting tool holds the plug in place such as by locking onto the shear stud while turning the setting ring to screw the setting ring toward the shoe during this installation or setting process, breaking away from the plug assembly by breaking the shear stud once a desired mechanical force between the mandrel and the upper slip is reached.

When the acidizing plug has served its purpose and removal is desired, the shear stud 508 is broken at the junction between the threaded stud portion and the threaded portion that engages the mandrel, revealing an opening in the threaded portion that engages the mandrel. This provides an opening to the breakable upper disk from the upper end of the acidizing plug, such that the breakable upper disc, made of a material such as ceramic, can be broken with a tool inserted in the top end of the acidizing plug. The same tool used to break the upper disk also breaks the breakable lower disk 506, enabling fluid such as hydrochloric acid to flow through the mandrel.

Hydrochloric acid is then introduced to flow through the center portion of the mandrel, including the acid-vulnerable portion between the breakable upper disk 504 and breakable lower disk 506. Because this portion of the mandrel is selected to be an acid-soluble material and is not treated to be acid-resistant, it dissolves readily in the acid and the acidizing plug breaks up. Insoluble parts such as the shear stud 508, carbide teeth 522, O-rings, and in a further example the sealing elements 524 and 526 come loose from the acidizing plug assembly and do not substantially obstruct the flow of oil or gas. In a further example, these non-soluble elements can be flushed out of the casing and separated from recovered oil and gas.

In another example, one or more other cavities, grooves, or other such features are incorporated into the acid-vulnerable surface of the mandrel to increase the surface area exposed to acid during the dissolving process, thereby reducing the time needed to dissolve the plug assembly. Soluble in various embodiments means that the mandrel will dissolve in a half hour, an hour, three hours, six hours, twelve hours, or a day.

In an alternate embodiment, the plug of FIG. 5 is a bridge plug rather than an acidizing plug, such that the plug is used to isolate a lower portion of an oil or gas well while work (such as acidizing) is being performed on an upper portion of the well. In one example of a bridge plug, a single breakable disk is needed to prevent acid from flowing from the upper portion of the well into an acid-vulnerable portion of the plug, and so only a single breakable disc is broken when work is complete to introduce acid to dissolve the bridge plug.

Figure 6:
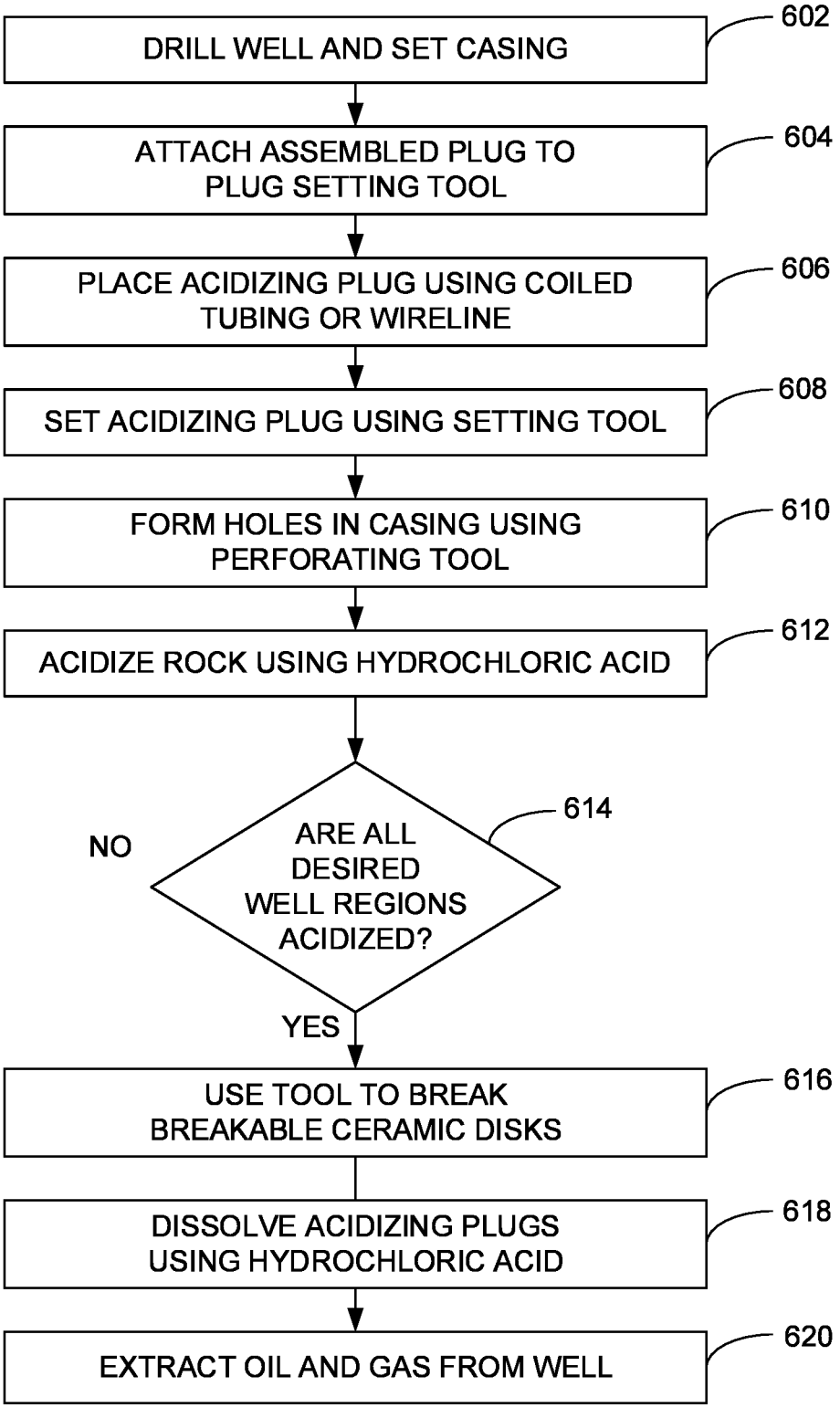
FIG. 6 is a flowchart, illustrating a method of using an acid-soluble acidizing plug in a plug-and-perf completion process in an oil and gas well.

FIG. 6 is a flowchart, illustrating a method of using an acid-soluble acidizing plug in a plug-and-perf completion process in an oil and gas well. At 602, the well is drilled and a casing is inserted into the bore hole and cemented in place. An acidizing plug is prepared for insertion into the casing at 604, including assembling the plug if needed, and attaching the assembled plug to a setting tool attached to a wireline or coiled tubing. The plug is lowered into position in the casing using the coiled tubing or wireline at 606, and is set using the setting tool at 608. At 610, a perforating tool is used to form holes in the casing between the set plug and the well head, and the wireline or coiled tubing is removed.

Rock formations surrounding the perforated portions of the casing are then acidized at 612 by pumping hydrochloric acid down the well. At 614, the driller determines whether all desired regions of the well have been perforated and acidized, and the process repeats for the next segment of the well at 604 if additional regions remain to be acidized. If the perforating and acidizing process is determined to be complete at 614, a tool is inserted to puncture, shatter, or drill the breakable plugs in the acidizing plugs at 618. The acidizing plugs are then removed or dislodged from their places in the casing at 616 using an acid such as hydrochloric acid that dissolves part or all of the plugs. The well is then ready for extracting oil or gas at 620.

The examples presented here illustrate how an acidizing plug for plug-and-perf oil and gas drilling applications can be formed at least partially from a material that is dissolvable or soluble in acid, facilitating easier and more certain removal of the acidizing plug after the acidizing process is complete. Further, dissolvable plugs such as those described here enable plug-and-perf fracking in wells that are deeper than can be currently employed due to the limitations of the traditional drilling process used to remove acidizing plugs.

Although specific embodiments have been illustrated and described herein, any arrangement that achieves the same purpose, structure, or function may be substituted for the specific embodiments shown. This application is intended to cover any adaptations or variations of the example embodiments of the invention described herein. These and other embodiments are within the scope of the following claims and their equivalents.

Having thus described the invention, what is claimed as new and desired to be secured by Letters Patent is:

1. An acidizing plug assembly, comprising:

a mandrel comprising a body having an outer cylindrical surface and an inner surface, the inner surface forming an opening in the mandrel body approximately parallel to the outer cylindrical surface's axis, the mandrel having an axis that extends in the same direction of the outer cylindrical surface's axis;

a sealing element comprising a flexible material having a cylindrical inner surface, installed along the outer cylindrical surface of the mandrel, and configured to seal the mandrel against a casing when force is applied to the sealing element in the direction of the mandrel's axis;

at least one backup ring comprising a semi-rigid or rigid material configured to having a cylindrical inner surface, each of the at least one backup rings installed along the outer cylindrical surface of the mandrel such that the backup ring is in contact with a surface of the sealing element;

at least one cone comprising a rigid material, each of the at least one cones having a cylindrical inner surface and installed along the outer cylindrical surface of the mandrel such that the cone is in in contact with the backup ring, each of the at least one cones comprising a ramp portion angled between five and forty degrees from the mandrel's axis;

at least one slip comprising a semi-rigid or rigid material, each of the at least one slips having a cylindrical inner surface and installed along the outer cylindrical surface of the mandrel such that the slip is adjacent to and in contact with the ramp portion of the cone, each of the at least one slips further comprising a plurality of teeth configured to bite into a casing when the slip is forced outward from the mandrel's axis, each slip operable to expand and be forced outward from the mandrel's axis when forced against the ramp portion of the adjacent cone;

a shoe configured to capture one or more of the sealing element, backup ring, cone, and slip on the mandrel; and at least one breakable plug located within the mandrel and blocking fluid flow into at least an acid-vulnerable portion of the opening in the mandrel body that is more vulnerable to acid than another portion of the mandrel body; wherein:

the at least one breakable plug comprises an upper breakable plug positioned adjacent a first end of the mandrel and spaced apart from a lower breakable plug positioned adjacent a second end of the mandrel, the upper and lower breakable plugs configured to shield the acid-vulnerable portion of the opening in the mandrel body therebetween, the acid-vulnerable portion of the opening in the mandrel body includes the inner surface of the mandrel between the upper breakable plug and the lower breakable plug, and the at least one breakable plug is selectively breakable to enable an acid to flow through the opening in the mandrel to dissolve the acid-vulnerable portion thereof.

2. The acidizing plug assembly of claim 1, wherein an exterior of the acidizing plug assembly is treated to be resistant to acid, and at least the acid-vulnerable portion of the opening in the mandrel body is not treated to be resistant to acid.

3. The acidizing plug assembly of claim 1, wherein the at least one breakable plug comprises at least one ceramic disk plug.

4. The acidizing plug assembly of claim 1, further comprising at least one o-ring, each at least one o-ring positioned in contact with each of the at least one breakable plugs and the mandrel inner surface, the at least one o-ring operable to form a seal between the at least one breakable plug and the mandrel body inner surface.

5. The acidizing plug assembly of claim 1, wherein:

the at least one backup ring comprises an upper backup ring and a lower backup ring;

the at least one cone comprises an upper cone and a lower cone such that the upper cone is in in contact with the upper backup ring and the lower cone is in contact with the lower backup ring, each of the upper and lower cones comprising a ramp portion angled between five and forty degrees from the mandrel's axis; and the at least one slip comprises an upper slip and a lower slip such that the upper slip is adjacent to and in contact with the ramp portion of the upper cone and the lower slip is adjacent to and in contact with the ramp portion of the lower cone.

6. The acidizing plug assembly of claim 1, wherein at least one of the mandrel, the at least one backup ring comprise an alloy of aluminum and/or magnesium, and are soluble in acid.

7. The acidizing plug assembly of claim 1, wherein the acid comprises hydrochloric acid.

8. The acidizing plug assembly of claim 1, wherein at least one of upper and lower backup rings are soluble in the acid.

9. The acidizing plug assembly of claim 1, wherein the mandrel is soluble in the acid.

10. The acidizing plug assembly of claim 9, wherein the mandrel comprises aluminum, magnesium, or an alloy of magnesium and/or aluminum.

11. The acidizing plug assembly of claim 1, wherein at least part of at least one of upper and lower slip are soluble in the acid.

12. The acidizing plug assembly of claim 1, wherein at least one of the upper slip, lower slip, and slip teeth are soluble in the acid.

13. The acidizing plug assembly of claim 1, wherein the plug assembly is configured to be used in matrix acidizing.

14. The acidizing plug assembly of claim 1, wherein the plug assembly is configured to be used in fracture acidizing.

15. An acidizing plug assembly, comprising:

a mandrel comprising a body having an outer surface configured to receive one or more additional components, the mandrel comprising an acid-vulnerable portion and a treated portion, such that the acid-vulnerable portion is more readily dissolvable in an acid than the treated portion, wherein the acid-vulnerable portion of the mandrel comprises at least an acid-vulnerable portion of an opening in the mandrel that includes an inner surface of the mandrel that is shielded by one or more breakable plugs selectively breakable to enable an acid to flow through the opening in the mandrel to dissolve the acid-vulnerable portion of the inner surface of the mandrel; and wherein the one or more breakable plugs include an upper breakable plug and a lower breakable plug positioned to shield the acid vulnerable portion therebetween, the upper and lower breakable plugs located within the opening in the mandrel and blocking fluid flow into the acid-vulnerable portion of the opening in the mandrel.

16. The acidizing plug assembly of claim 15, wherein the one or more additional components comprise one or more of a sealing element, one or more backup rings, one or more cones, and one or more slips.

17. The acidizing plug assembly of claim 16, wherein at least one of the one or more additional components are soluble in the acid.

18. The hydraulic fracking plug assembly of claim 17, wherein at least 50% of the fracking plug assembly by volume is soluble in the acid.

* * * * *